US007896070B2

(12) United States Patent
Lovell

(10) Patent No.: US 7,896,070 B2
(45) Date of Patent: Mar. 1, 2011

(54) PROVIDING AN EXPANDABLE SEALING ELEMENT HAVING A SLOT TO RECEIVE A SENSOR ARRAY

(75) Inventor: John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/101,198

(22) Filed: Apr. 11, 2008

(65) Prior Publication Data

US 2008/0185144 A1 Aug. 7, 2008

Related U.S. Application Data

(63) Continuation-in-part of application No. 11/688,089, filed on Mar. 19, 2007, now Pat. No. 7,735,555.

(60) Provisional application No. 60/787,592, filed on Mar. 30, 2006, provisional application No. 60/745,469, filed on Apr. 24, 2006, provisional application No. 60/747,986, filed on May 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007.

(51) Int. Cl.
*E21B 33/12* (2006.01)
*E21B 47/01* (2006.01)
*G01V 8/24* (2006.01)

(52) U.S. Cl. ..... 166/250.01; 166/66; 166/179; 340/854.7

(58) Field of Classification Search ..... 166/179, 166/66, 250.01; 340/854.7; 356/478
See application file for complete search history.

(56) References Cited

U.S. PATENT DOCUMENTS

| | | | | |
|---|---|---|---|---|
| 3,344,860 | A | 10/1967 | Voetter | |
| 6,173,772 | B1 | 1/2001 | Vaynshteyn | |
| 6,173,788 | B1 * | 1/2001 | Lembcke et al. | 166/387 |
| 6,378,610 | B2 | 4/2002 | Rayssiguier | |
| 6,513,599 | B1 | 2/2003 | Bixenman | |
| 6,787,758 | B2 * | 9/2004 | Tubel et al. | 250/227.14 |
| 7,201,226 | B2 | 4/2007 | Gambier | |
| 7,234,533 | B2 | 6/2007 | Gambier | |
| 7,264,061 | B2 * | 9/2007 | Dybevik et al. | 166/385 |
| 7,322,422 | B2 | 1/2008 | Patel | |
| 2005/0199401 | A1 | 9/2005 | Patel | |
| 2005/0236161 | A1 * | 10/2005 | Gay et al. | 166/380 |
| 2006/0016593 | A1 | 1/2006 | Gambier | |
| 2007/0012436 | A1 * | 1/2007 | Freyer | 166/179 |
| 2007/0027245 | A1 | 2/2007 | Vaidya | |
| 2007/0062710 | A1 | 3/2007 | Pelletier | |

(Continued)

FOREIGN PATENT DOCUMENTS

| | | |
|---|---|---|
| EP | 1570151 | 7/2007 |

*Primary Examiner*—Kenneth Thompson
(74) *Attorney, Agent, or Firm*—Brandon S. Clark; Rodney V. Warfford

(57) ABSTRACT

A completion assembly has an expandable sealing element provided on an outer surface of the completion assembly. The expandable sealing element has a slot. The slot of the expandable sealing element enables the expandable sealing element to expand around a spoolable sensor array.

30 Claims, 5 Drawing Sheets

U.S. PATENT DOCUMENTS

2007/0142547 A1 6/2007 Vaidya
2007/0151724 A1 7/2007 Ohmer
2008/0066900 A1 3/2008 Saebi

* cited by examiner

PROVIDING AN EXPANDABLE SEALING ELEMENT HAVING A SLOT TO RECEIVE A SENSOR ARRAY

CROSS-REFERENCE TO RELATED APPLICATIONS

This is a continuation-in-part of U.S. Ser. No. 11/688,089, entitled "Completion System Having a Sand Control Assembly, an Inductive Coupler, and a Sensor Proximate the Sand Control Assembly," filed Mar. 19, 2007, which claims the benefit under 35 U.S.C. §119(e) of the following provisional patent applications: U.S. Ser. No. 60/787,592, entitled "Method for Placing Sensor Arrays in the Sand Face Completion," filed Mar. 30, 2006; U.S. Ser. No. 60/745,469, entitled "Method for Placing Flow Control in a Temperature Sensor Array Completion," filed Apr. 24, 2006; U.S. Ser. No. 60/747,986, entitled "A Method for Providing Measurement System During Sand Control Operation and Then Converting It to Permanent Measurement System," filed May 23, 2006; U.S. Ser. No. 60/865,084, entitled "Welded, Purged and Pressure Tested Permanent Downhole Cable and Sensor Array," filed Nov. 9, 2006; U.S. Ser. No. 60/866,622, entitled "Method for Placing Sensor Arrays in the Sand Face Completion," filed Nov. 21, 2006; U.S. Ser. No. 60/867,276, entitled "Method for Smart Well," filed Nov. 27, 2006 and U.S. Ser. No. 60/890,630, entitled "Method and Apparatus to Derive Flow Properties Within a Wellbore," filed Feb. 20, 2007. Each of the above applications is hereby incorporated by reference.

TECHNICAL FIELD

The invention relates generally to providing an expandable sealing element having a slot to receive a sensor array.

BACKGROUND

A completion system is installed in a well to produce hydrocarbons (or other types of fluids) from reservoirs) adjacent the well, or to inject fluids into the reservoir(s). Sensors are typically installed in completion systems to measure various parameters, including temperature, pressure, and other well parameters that are useful for monitoring the status of the well and the fluids that are flowing in the well.

In some scenarios, presence of certain components in the completion system can make deployment of sensors difficult. One such example component is a packer used to seal around a portion of the completion system to isolate zones in the well. In many conventional systems, to allow for deployment of sensors past a sealing packer, a packer is provided with an axial port (which is a feedthrough port extending axially through the packer) to allow a communication line connected to the sensor to be passed through the packer. Typically, the communication line has to be spliced at the ported packer to allow the communication line to pass through the ported packer. However, an issue with splicing the communication line is that maintaining a hermetic seal would not be feasible since the communication line would have to be in separate segments to achieve the splicing. Also, performing splicing at the job site is time consuming and costly.

In other conventional configurations, instead of using ported packers, communication lines can be extended through a housing of a completion assembly on which the packer is mounted to avoid interference with the packer. However, such arrangements also add to the complexity and cost of the completion system.

SUMMARY

In general, according to an embodiment, an apparatus for use in a well includes a completion assembly, and an expandable sealing element provided on the outer surface of the completion assembly. The expandable element has a slot. The apparatus further includes a sensor array. The slot in the expandable sealing element enables the expandable sealing element to expand around the sensor array.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
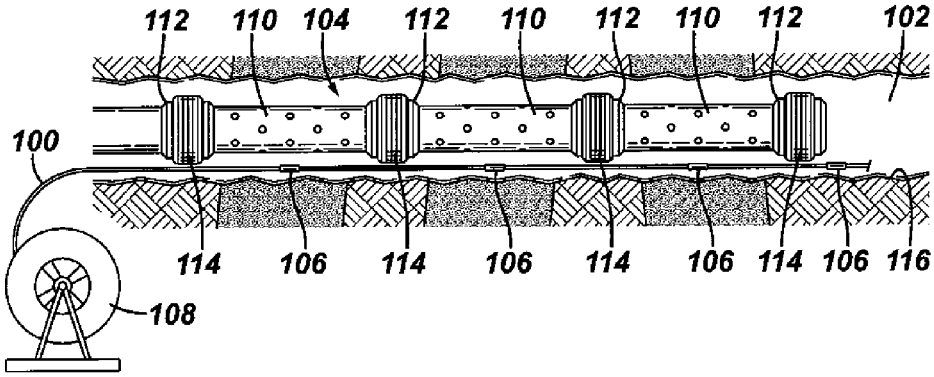
FIG. 1 illustrates an example arrangement that has a sensor array wound on a spool, where the sensor array can be deployed into a well by unwinding from the spool for attachment to a completion system.

FIG. 1 illustrates an example arrangement that includes a sensor array 100 for deployment into a well 102. The sensor array 100 is attached to a completion system 104 for deployment into the well 102. A sensor array includes a continuous communication line having portions with sensors 106. The sensor array 100 is "continuous" in the sense that the sensor array provides a continuous seal against external fluids, such as wellbore fluids, along its length. Note that in some embodiments, the continuous sensor array 100 can actually have discrete housing sections that are sealably attached together, such as by welding or by some other sealing mechanism. In other embodiments, the sensor array can be implemented with an integrated, continuous housing formed without breaks.

The sensor array 100 has an inner bore that can be hermetically sealed from an external environment. For example, the inner bore of the sensor array 100 can be filled with an inert gas (e.g., argon).

The sensor array 100 is wound onto a spool 108, which is positioned at an earth surface or offshore platform above the well 102. Initially, the entire length of the sensor array 100 may be wound onto the spool 108. At the well site, as the completion system 104 is deployed into the wellbore 102, the sensor array 106 can be unwound and attached to the completion system 104, with both the combination of the completion system 104 and sensor array 100 inserted into the wellbore 102 together. Such a sensor array that is deployable into a wellbore from a spool is often referred to as a "spoolable sensor array."

The completion system 104, in the example depicted in FIG. 1, has perforated pipe sections 110 to enable flow of fluids between the outside of the completion system 104 (wellbore annulus) and an inner bore of the completion system 104. In alternative implementations, other types of completion systems 104 can be used.

The pipe sections 110 are interconnected by connection mandrels 112. Expandable sealing elements 114, such as sealing packers, are arranged on outer surfaces of corresponding connection mandrels 112. When the completion system 104 is deployed into the wellbore, the sealing elements 114 are initially in an unexpanded, deflated or retracted state such that the sealing elements 114 are withdrawn from an inner surface 116 of the wellbore 102. This allows for movement of the completion system 104 inside the wellbore 102.

An "expandable sealing element" refers to a sealing element that is enlargeable from a first radial point to a second radial point. One example of an expandable sealing element is a swellable sealing element that swells in response to an activating chemical. Another example of an expandable sealing element is an inflatable sealing element that is inflated by application of fluid pressure.

Once the completion system 104 is lowered to a target depth in the wellbore 102, the sealing elements 114 are activated to expand radially outwardly from the completion system 104 to engage the inner surface 116 of the wellbore 102. Engagement of the sealing elements 114 against the inner surface 116 of the wellbore allows for a fluid seal to be provided by such engagement. The inner surface 116 of the wellbore can either be a surface of a casing or liner (e.g., that lines the wellbore) or the inner wall of an open (i.e., un-cased or un-lined) wellbore.

In alternative implementations, instead of providing a complete seal by engaging the sealing elements 114 against the wellbore surface 116, partial seals can be provided instead, where the sealing elements 114 expand radially outwardly to constrict or narrow an area of an annular flow path, which can be used to achieve a desired pressure drop for example.

As explained further below, in accordance with some embodiments, slots are provided in the sealing elements 114 to receive portions of the sensor array 100. The slot in each sealing element 114 allows the sealing element 114 to expand outwardly around the sensor array 100 for engagement with the inner surface 116 of the wellbore 102. Note that the sensor array 100 is sealably received inside the slot of each sealing element 114 such that a fluid seal may be provided between the sensor array 100 and the expandable sealing element 114 when the sealing element 114 is in an expanded state. This allows for proper sealing by each expandable sealing element 114 in the annular region between the completion system 104 and the wellbore 102 such that different zones of the wellbore 102 can be isolated.

Note that a slot can be pre-formed in the sealing element 114, or alternatively, a slot can be formed in the sealing element 114 after deployment of the sealing element into the wellbore. The sealing element can be formed of a material into which a slot can be readily made without preventing the element's ability to perform its desired function. In this discussion, reference to a "slot" of a sealing element is to either a pre-formed slot or a slot created after deploying the sealing element into the wellbore.

Figure 2A:
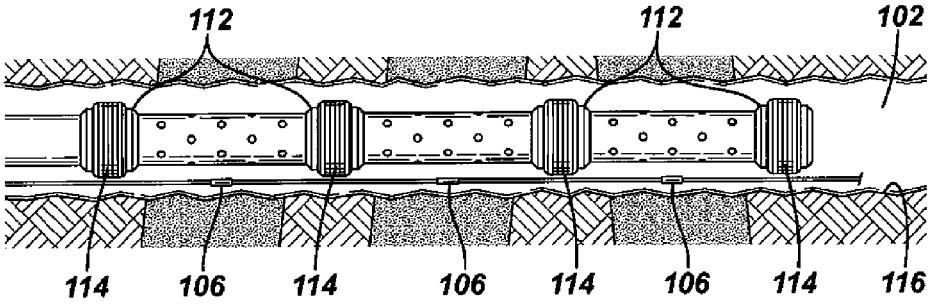
FIGS. 2A-2B illustrate the completion system with expanding sealing elements having slots to receive the sensor array, in accordance with an embodiment.
Figure 2B:
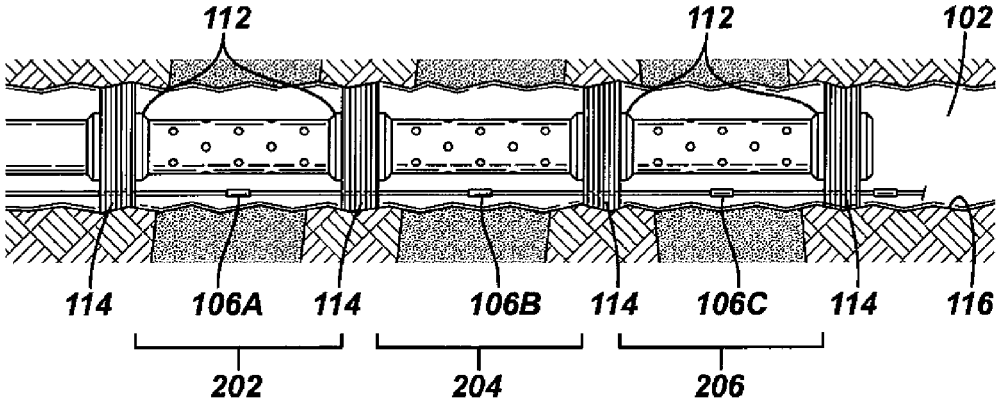

FIG. 2A shows the initial deployment of the completion system 104 and sensor array 100 in the wellbore 102, in which the expandable sealing elements 114 are in their initial deflated state. FIG. 2B, on the other hand, shows that the expandable sealing elements 114 have been activated to expand radially outwardly to engage the inner surface 116 of the wellbore 102. Activation of the sealing elements 114 can be accomplished in one of a number of ways, including activation based on applying fluid pressure, providing an activating chemical to cause the expandable sealing elements 114 to swell, and so forth. As depicted in FIG. 2B, the expanded sealing elements 114 have sealed around the sensor array 100 and have engaged the wellbore inner surface 116. As a result, zones 202, 204, and 206 are defined, where each of the zones 202, 204, and 206 is isolated from other portions of the wellbore 102.

Note that within each of the zones 202, 204, and 206, at least one sensor can be provided. For example, a sensor 106A is provided in zone 202, a sensor 106B is provided in zone 204, and a sensor 106C is provided in zone 206. The respective sensor 106A, 106B, or 106C can be used to measure a property of the corresponding zone 202, 204, or 206. The measured property can include temperature, pressure, flow rate, fluid property, and so forth. The array of measurements can in turn be used to derive properties or characteristics of the wellbore such as the flow of reservoir fluid into the formation, for example to allocate flow across different producing zones. The data from the permanently installed sensor array can be combined with other reservoir and wellbore information, for example, from logging data that was obtained while drilling the well or obtained during a subsequent intervention.

The zones 202, 204, and 206 are adjacent corresponding zones of a reservoir 210 through which the wellbore 102 extends. Fluid (e.g., hydrocarbon, fresh water, etc.) can be produced from the reservoir zones into the corresponding zones 202, 204, and 206. Alternatively, fluids can be injected into the reservoir 210 through the zones 202, 204 and 206.

Figure 3:
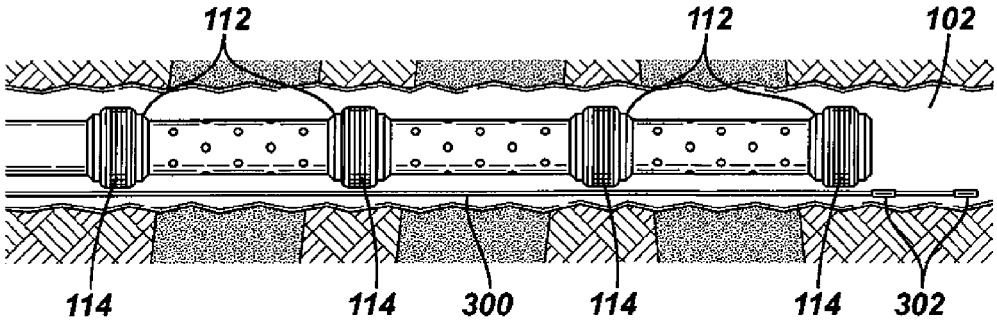
FIG. 3 illustrates the completion system with expanding sealing elements having slots to receive a sensor array that has one or more sensors, according to another embodiment.

Although reference has been made to a sensor array in the foregoing discussion, it is noted that, in an alternative embodiment, a similar technique can be applied to a more traditional communications arrangement in which one or more sensors are connected to a communication line. Such an arrangement is depicted in FIG. 3, which shows a communication line 300 that has one end connected to one or more sensors 302. The expandable sealing elements 114 with their respective slots are able to seal around the communication line 300 for engagement with the inner surface 116 of the wellbore. This assembly of the communication line 300 and the one or more sensors 302 may also be referred to as a "sensor array."

Figure 4:
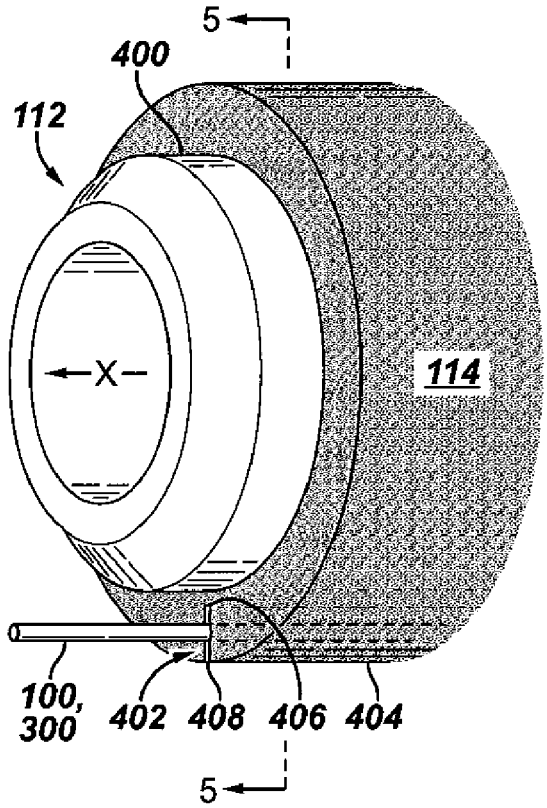
FIG. 4 illustrates an assembly of a completion system housing segment, a sensor array, and an expandable sealing element having a slot to receive the sensor array, according to an embodiment.
Figure 5:
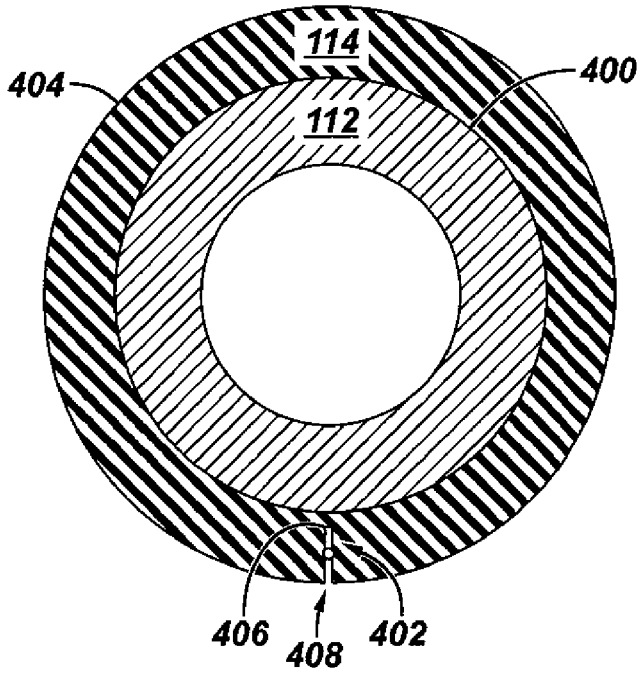
FIG. 5 is a cross-sectional view of a portion of the assembly of FIG. 4.

FIG. 4 illustrates a portion of an assembly of a connector mandrel 112, an expandable sealing element 114, and a sensor array 100 or 300. FIG. 5 is a cross-sectional view of the assembly of FIG. 4. As depicted, the expandable sealing element 114 is provided on an outer surface 400 of the connector mandrel 112. A slot 402 is provided in the expandable sealing element 114. The slot 402 extends in a radial direction in the sealing element 114 from the outermost surface 404 of the sealing element 114 to a point 406 closer to the connector mandrel outer surface 400. In the axial direction (indicated by X), the slot 402 extends along the length of the expandable sealing element 114. The sensor array 100 or 300 is received in the slot 402. The slot 402 has an open end 408 at the outermost surface 404 of the expandable sealing element 114, where the open end 408 of the slot 402 is able to receive the sensor array 100 or 300 that is initially not received in the slot 402.

Figure 6A:
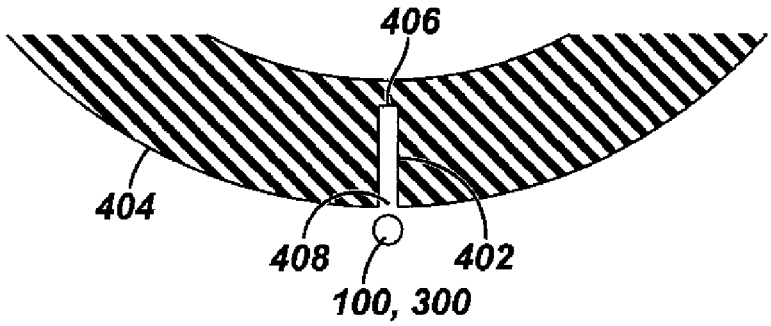
FIGS. 6A-6C illustrate a sensor array being received into a slot of an expandable sealing element, according to an embodiment.
Figure 6B:
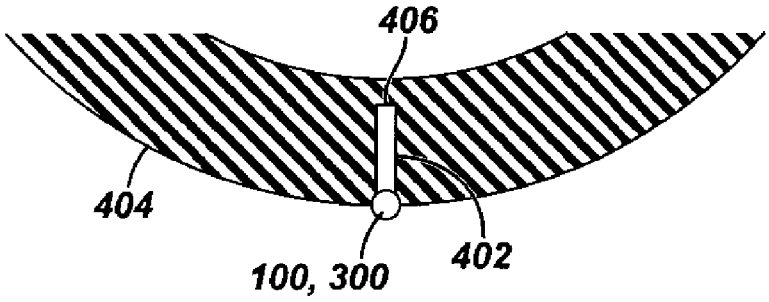
Figure 6C:
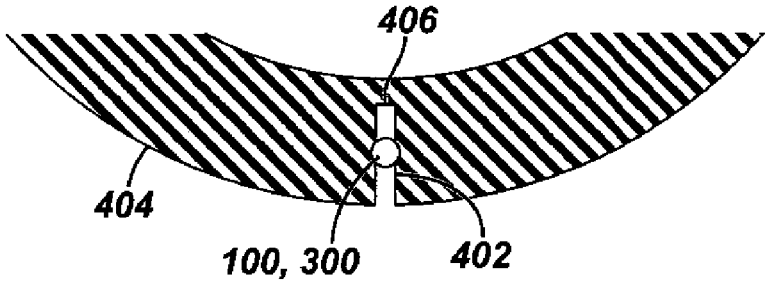

Receipt of the sensor array in the slot 402 is depicted in FIGS. 6A-6C. In FIG. 6A, the sensor array 100 or 300 is depicted as being outside the expandable sealing element 114 prior to being received in the slot 402. FIG. 6B shows the sensor array 100 or 300 as it is initially received at the open end 408 of the slot 402. FIG. 6C shows the sensor array 100 or 300 received deeper (in the radial direction) into the slot 402. Effectively, the slot 402 allows the sensor array 100 or 300 to be gradually received deeper into the slot 402 as the sealing element 112 expands.

By using a slot 402 that has an open end (end 408), a ported packer does not have to be used, since the expandable sealing element 114 can receive the sensor array 100 or 300 and seal around the sensor array 100 or 300 as the sealing element 112 expands.

By using techniques according to some embodiments, the expandable sealing elements 114 can be set against impermeable zones of a reservoir through which the wellbore 102 extends. Once set, the expandable sealing elements 114 provide zonal isolation such that flow can be produced from specific reservoir zones to flow within the wellbore. The sensors provided in each of the zones allow for measurement of characteristics associated with the flow.

The system according to some embodiments can also be used for reservoir stimulation in which a certain fluid, such as acid, can be pumped between two sealing elements in an isolated zone.

The system according to some embodiments can also be used in an injector well, where the sealing elements isolate injected fluids to particular zones of the reservoir. The sensors can be used to measure data so that fluid injection can be optimized. For example, the injection pressure can be monitored to keep it below the pressure that would fracture the rock.

A communication line that is part of a sensor array can also be used for deploying optical fibers across a wellbore with packers. In this case, a communication line has an inner axial bore. Once the communication line is deployed downhole, and the sealing elements 114 are expanded to seal around the communication line, an optical fiber can be pumped down the control line and positioned across a desired reservoir without the need for any splicing. The optical fiber can be used for performing distributed temperature sensing (in which the entire length of the optical fiber can be used to determine a temperature profile along the length). Alternatively, the optical fiber can be connected to the sensors.

In some embodiments, a completion system having at least two stages (an upper completion section and a lower completion section) is used. The lower completion section is run into the well in a first trip, where the lower completion section includes the sensor assembly. An upper completion section is then run in a second trip, where the upper completion section is able to be inductively coupled to the first completion section to enable communication and power between the sensor assembly and another component that is located uphole of the sensor assembly. The inductive coupling between the upper and lower completion sections is referred to as an inductively coupled wet connect mechanism between the sections. "Wet connect" refers to electrical coupling between different stages (run into the well at different times) of a completion system in the presence of well fluids. The inductively coupled wet connect mechanism between the upper and lower completion sections enables both power and signaling to be established between the sensor assembly and uphole components, such as a component located elsewhere in the wellbore at the earth surface.

The term two-stage completion should also be understood to include those completions where additional completion components are run in after the first upper completion, such as commonly used in some cased-hole frac-pack applications. In such wells, inductive coupling may be used between the lowest completion component and the completion component above, or may be used at other interfaces between completion components. A plurality of inductive couplers may also be used in the case that there are multiple interfaces between completion components.

Induction is used to indicate transference of a time-changing electromagnetic signal or power that does not rely upon a closed electrical circuit, but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoidal coils on the surface of the earth can be used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first.

In alternative embodiments, the sensor assembly can be provided with the upper completion section rather than with the lower completion section. In yet other embodiments, a single-stage completion system can be used.

Although reference is made to upper completion sections that are able to provide power to lower completion sections through inductive couplers, it is noted that lower completion sections can obtain power from other sources, such as batteries, or power supplies that harvest power from vibrations (e.g., vibrations in the completion system). Examples of such systems have been described in U.S. Publication No. 2006/0086498. Power supplies that harvest power from vibrations can include a power generator that converts vibrations to power that is then stored in a charge storage device, such as a battery. In the case that the lower completion obtains power from other sources, the inductive coupling will still be used to facilitate communication across the completion components.

Figure 7:
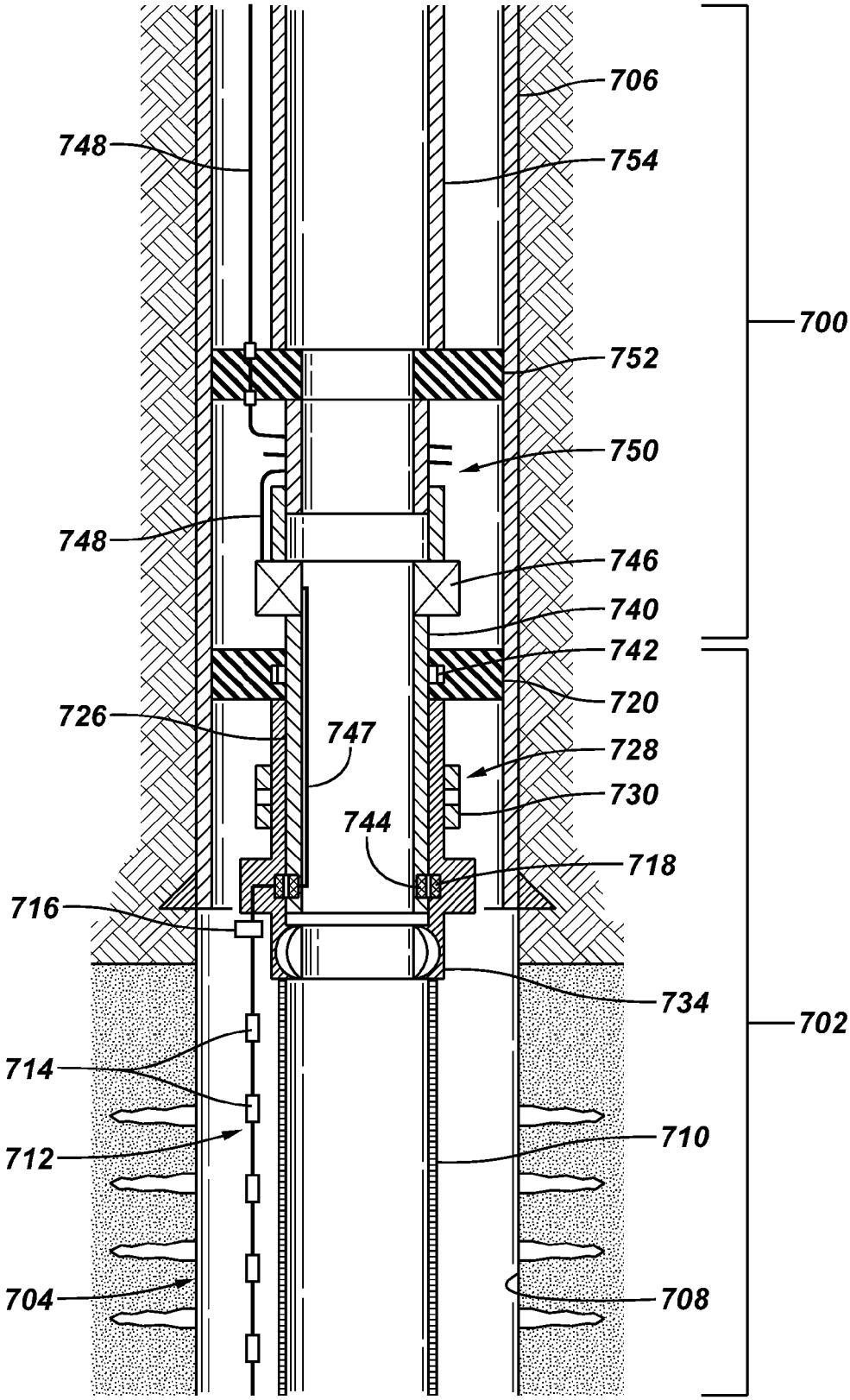
FIG. 7 shows a two-stage completion system according to an embodiment.

Reference is made to FIG. 7 in the ensuing discussion of a two-stage completion system according to an embodiment.

FIG. 7 shows the two-stage completion system with an upper completion section 700 engaged with a lower completion section 702.

As shown in FIG. 7, an open hole region is below a lined or cased region that has a liner or a casing 706. In the open hole region, a portion of the lower completion section 702 is provided proximate to a sand face 708.

To prevent passage of particulate material, such as sand, a sand screen 710 is provided in the lower completion section 702. Alternatively, other types of sand control assemblies can be used, including slotted or perforated pipes or slotted or perforated liners. A sand control assembly is designed to filter particulates, such as sand, to prevent such particulates from flowing from a surrounding reservoir into a well.

In accordance with some embodiments, the lower completion section 702 has a sensor assembly (or array) 712 that has multiple sensors 714 positioned at various discrete locations across the sand face 708. In some embodiments, the sensor assembly 712 is in the form of a sensor cable (also referred to as a "sensor bridle"). The sensor cable 712 is basically a continuous control line having portions in which sensors 714 are provided. The sensor cable 712 is "continuous" in the sense that the sensor cable provides a continuous seal against fluids, such as wellbore fluids, along its length. Note that in some embodiments, the continuous sensor cable can actually have discrete housing sections that are sealably attached together. In other embodiments, the sensor cable can be implemented with an integrated, continuous housing without breaks.

In the lower completion section 702, the sensor cable 712 is also connected to a controller cartridge 716 that is able to communicate with the sensors 714. The controller cartridge 716 is able to receive commands from another location (such as at the earth surface or from another location in the well, e.g., from control station 746 in the upper completion section 700). These commands can instruct the controller cartridge 716 to cause the sensors 714 to take measurements or send measured data. Also, the controller cartridge 716 is able to store and communicate measurement data from the sensors 714. Thus, at periodic intervals, or in response to commands, the controller cartridge 716 is able to communicate the measurement data to another component (e.g., control station 746) that is located elsewhere in the wellbore or at the earth surface. Generally, the controller cartridge 716 includes a processor and storage. The communication between sensors 714 and control cartridge 716 can be bi-directional or can use a master-slave arrangement.

The controller cartridge 716 is electrically connected to a first inductive coupler portion 718 (e.g., a female inductive coupler portion) that is part of the lower completion section 702. As discussed further below, the first inductive coupler portion 718 allows the lower completion section 702 to electrically communicate with the upper completion section 700 such that commands can be issued to the controller cartridge 716 and the controller cartridge 716 is able to communicate measurement data to the upper completion section 700.

In embodiments in which power is generated or stored locally in the lower completion section, the controller cartridge 716 can include a battery or power supply.

As further depicted in FIG. 7, the lower completion section 702 includes a packer 720 (e.g., gravel pack packer) that when set seals against casing 706. The packer 720 isolates an annulus region under the packer 720, where the annulus region is defined between the outside of the lower completion section 702 and the inner wall of the casing 706 and the sand face 708.

A seal bore assembly 726 extends below the packer 720, where the seal bore assembly 726 is to sealably receive the upper completion section 700. The seal bore assembly 726 is further connected to a circulation port assembly 728 that has a slidable sleeve 730 that is slidable to cover or uncover circulating ports of the circulating port assembly 728. During a gravel pack operation, the sleeve 730 can be moved to an open position to allow gravel slurry to pass from the inner bore 732 of the lower completion section 702 to the annulus region 724 to perform gravel packing of the annulus region 724. The gravel pack formed in the annulus region 724 is part of the sand control assembly designed to filter particulates.

In the example implementation of FIG. 7, the lower completion section 702 further includes a mechanical fluid loss control device, e.g., formation isolation valve 734, which can be implemented as a ball valve. When closed, the ball valve isolates a lower part of the inner bore from the part of the inner bore above the formation isolation valve 734. When open, the formation isolation valve 734 can provide an open bore to allow flow of fluids as well as passage of intervention tools. Although the lower completion section 702 depicted in the example of FIG. 7 includes various components, it is noted that in other implementations, some of these components can be omitted or replaced with other components.

As depicted in FIG. 7, the sensor cable 712 is provided in the annulus region outside the sand screen 710. By deploying the sensors 714 of the sensor cable 712 outside the sand screen 710, well control issues and fluid losses can be avoided by using the formation isolation valve 734. Note that the formation isolation valve 734 can be closed for the purpose of fluid loss control during installation of the two-stage completion system.

As depicted in FIG. 7, the upper completion section 700 has a straddle seal assembly 740 for sealing engagement inside the seal bore assembly 726 of the lower completion section 702. The outer diameter of the straddle seal assembly 740 of the upper completion section 700 is slightly smaller than the inner diameter of the seal bore assembly 726 of the lower completion section 702. This allows the upper completion section straddle seal assembly 740 to sealingly slide into the lower completion section seal bore assembly 726. In an alternate embodiment the straddle seal assembly can be replaced with a stinger that does not have to seal.

Arranged on the outside of the upper completion section straddle seal assembly 740 is a snap latch 742 that allows for engagement with the packer 720 of the lower completion section 702. When the snap latch 742 is engaged in the packer 720, as depicted in FIG. 7, the upper completion section 700 is securely engaged with the lower completion section 702. In other implementations, other engagement mechanisms can be employed instead of the snap latch 742.

Proximate to the lower portion of the upper completion section 700 (and more specifically proximate to the lower portion of the straddle seal assembly 740) is a second inductive coupler portion 744 (e.g., a male inductive coupler portion). When positioned next to each other, the second inductive coupler portion 744 and first inductive coupler portion 718 (as depicted in FIG. 7) form an inductive coupler that allows for inductively coupled communication of data and power between the upper and lower completion sections.

An electrical conductor 747 (or conductors) extends from the second inductive coupler portion 744 to the control station 746, which includes a processor and a power and telemetry module (to supply power and to communicate signaling with the controller cartridge 716 in the lower completion section 702 through the inductive coupler). The control station 746 can also optionally include sensors, such as temperature and/or pressure sensors.

The control station 746 is connected to an electric cable 748 (e.g., a twisted pair electric cable) that extends upwardly to a contraction joint 750 (or length compensation joint). At the contraction joint 750, the electric cable 748 can be wound in a spiral fashion (to provide a helically wound cable) until the electric cable 748 reaches an upper packer 752 in the upper completion section 700. The upper packer 752 is a ported packer to allow the electric cable 748 to extend through the packer 752 to above the ported packer 752. The electric cable 748 can extend from the upper packer 752 all the way to the earth surface (or to another location in the well).

In another embodiment, the control station 746 can be omitted, and the electrical cable 748 can run from the second inductive coupler portion 744 (of the upper completion section 700) to a control station elsewhere in the well or at the earth surface.

The contraction joint 750 is optional and can be omitted in other implementations. The upper completion section 700 also includes a tubing 754, which can extend all the way to the earth surface. The upper completion section 700 is carried into the well on the tubing 754.

In operation, the lower completion section 702 is run in a first trip into the well and is installed proximate to the open hole section of the well. The packer 720 (FIG. 2) is then set, after which a gravel packing operation can be performed. To perform the gravel packing operation, the circulating port assembly 728 is actuated to an open position to open the port(s) of the circulating port assembly 728. A gravel slurry is then communicated into the well and through the open port(s) of the circulating port assembly 728 into the annulus region 724. The annulus region 724 is then filled with slurry until the annulus region 724 is gravel packed.

Next, in a second trip, the upper completion section 700 is run into the well and attached to the lower completion section 702. Once the upper end lower completion sections are engaged, communication between the controller cartridge 716 and the control station 746 can be performed through the inductive coupler that includes the inductive coupler portions 718 and 744. The control station 746 can send commands to the controller cartridge 716 in the lower completion section 702, or the control station 746 can receive measurement data collected by the sensors 714 from the controller cartridge 716.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a well, comprising:

a completion assembly;

an expandable sealing element provided on an outer surface of the completion assembly, wherein the expandable sealing element has a slot; and a sensor array including a continuous line having portions containing respective sensors, wherein the continuous line provides a continuous seal against external fluids in the well, and wherein the continuous line has an inner bore hermetically sealed from the well and is filled with an inert gas, wherein the slot of the expandable sealing element enables the expandable sealing element to expand around a portion of the sensor array.

2. The apparatus of claim 1, wherein the slot extends from an outer surface of the sealing element radially inwardly, and wherein the slot has an open end to receive the sensor array.

3. The apparatus of claim 2, wherein as the sealing element expands, the sensor array is received deeper into the slot.

4. The apparatus of claim 3, wherein the slot further extends along an axial direction of the sealing element, and wherein the sensor array also extends along the axial direction of the sealing element.

5. The apparatus of claim 1, further comprising a second expandable sealing element provided on the outer surface of the completion assembly, wherein the second expandable sealing element has a second slot to receive another portion of the sensor array, and wherein the second slot enables the second expandable sealing element to expand around the sensor array.

6. The apparatus of claim 5, wherein the expandable sealing elements when expanded and engaged against an inner surface of the well define plural zones, and wherein at least a corresponding one of the sensors is provided in each of the zones.

7. The apparatus of claim 1, wherein the slot is either pre-formed in the sealing element or created in the sealing element after deployment of the sealing element in the well.

8. The apparatus of claim 7, further comprising a spool, wherein the sensor array is configured to be deployed by unwinding from the spool on which the sensor array is initially wound.

9. The apparatus of claim 1, wherein the expandable sealing element is an inflatable sealing element that is inflatable by fluid pressure.

10. The apparatus of claim 1, wherein the expandable sealing element is a swellable sealing element that is swelled by an activating chemical.

11. The apparatus of claim 1, further comprising an optical fiber in the continuous line and connected to the sensors.

12. The apparatus of claim 1, wherein the sensors are discrete sensors provided in the corresponding portions in the inner bore of the continuous line.

13. The apparatus of claim 1, further comprising an inductive coupler coupled to the sensor array to communicate measurement data from the sensors of the sensor array to another device.

14. The apparatus of claim 13, wherein the completion assembly is a first completion assembly, wherein a first portion of the inductive coupler is part of the first completion assembly, the apparatus further comprising:

a second completion assembly engaged with the first completion assembly, wherein the second completion assembly has an electrical conductor connected to a second portion of the inductive coupler that is part of the second completion assembly.

15. A system comprising:

a spool for location at an earth surface above a well, wherein the spool includes a sensor array wound on the spool, wherein the sensor array includes a continuous line having portions containing respective sensors, wherein the continuous line provides a continuous seal against external fluids in the well, and wherein the continuous line has an inner bore hermetically sealed from the well and is filled with an inert gas;

a completion assembly for deployment in the well; and wherein the sensor array is configured to be unwound from the spool for deployment into the well with the completion assembly, and wherein the completion assembly has at least one expandable sealing element provided on an outer surface of the completion assembly, the expandable sealing element having a slot, wherein the sensor array is positioned to be received gradually deeper into the slot as the expandable sealing element expands.

16. The system of claim 15, wherein the slot has an open end at an outer surface of the expandable sealing element, the open end to receive the sensor array.

17. The system of claim 16, wherein the expandable sealing element is sealed against the sensor array that is positioned inside the slot when the expandable sealing element is in an expanded state.

18. The system of claim 15, further comprising an optical fiber in the continuous line and connected to the sensors.

19. The system of claim 15, wherein the sensors are discrete sensors provided in the corresponding portions in the inner bore of the continuous line.

20. The system of claim 15, further comprising an inductive coupler coupled to the sensor array to communicate measurement data from the sensors of the sensor array to another device.

21. The system of claim 20, wherein the completion assembly is a first completion assembly, wherein a first portion of the inductive coupler is part of the first completion assembly, the system further comprising:

a second completion assembly engaged with the first completion assembly, wherein the second completion assembly has an electrical conductor connected to a second portion of the inductive coupler that is part of the second completion assembly.

22. A method for use in a well, comprising:

deploying a completion assembly into the well, wherein the completion assembly has an expandable sealing element provided on an outer surface of the completion assembly, and wherein the expandable sealing element has a slot;

deploying a sensor array into the well with the completion assembly, wherein the sensor array is attached to the completion assembly and the sensor array includes a continuous line having portions containing respective sensors, wherein the continuous line provides a continuous seal against external fluids in the well, and wherein the continuous line has an inner bore hermetically sealed from the well and is filled with an inert gas;

activating the expandable sealing element to cause the sealing element to expand radially outwardly, wherein the sensor array is received in the slot as the expandable sealing element expands around the sensor array.

23. The method of claim 22, wherein the expandable sealing element is an inflatable sealing element, and wherein activating the inflatable sealing element comprises providing a fluid pressure to inflate the inflatable sealing element.

24. The method of claim 22, further comprising unwinding the sensor array from a spool located at an earth surface above the well for deploying the sensor array into the well.

25. The method of claim 22, wherein activating the expandable sealing element causes at least one zone to be isolated, wherein a sensor of the sensor array is provided in the isolated zone to measure a property associated with the zone.

26. The method of claim 22, further comprising deploying an optical fiber into the continuous line.

27. The method of claim 26, further comprising connecting the optical fiber to the sensors.

28. The method of claim 22, wherein the sensors are discrete sensors provided in the corresponding portions in the inner bore of the continuous line.

29. The method of claim 22, further comprising:

providing an inductive coupler coupled to the sensor array; and communicating measurement data from the sensors of the sensor array to another device.

30. The method of claim 29, wherein the completion assembly is a first completion assembly, wherein a first portion of the inductive coupler is part of the first completion assembly, the method further comprising:

engaging a second completion assembly with the first completion assembly after the first completion assembly has been deployed in the well, wherein the second completion assembly has an electrical conductor connected to a second portion of the inductive coupler that is part of the second completion assembly.

* * * * *